US011807923B2

(12) United States Patent
Izumida et al.

(10) Patent No.: US 11,807,923 B2
(45) **Date of Patent: *Nov. 7, 2023**

(54) SPRING STEEL WIRE

(71) Applicant: Sumitomo Electric Industries, Ltd., Osaka (JP)

(72) Inventors: Hiromu Izumida, Osaka (JP); Tetsuya Nakajima, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 264 days.

This patent is subject to a terminal disclaimer.

(21) Appl. No.: 17/058,459

(22) PCT Filed: Jun. 17, 2020

(86) PCT No.: PCT/JP2020/023718
§ 371 (c)(1),
(2) Date: Nov. 24, 2020

(87) PCT Pub. No.: WO2021/255848
PCT Pub. Date: Dec. 23, 2021

(65) Prior Publication Data

US 2022/0186349 A1 Jun. 16, 2022

(51) Int. Cl.
*C22C 38/18* (2006.01)
*C22C 38/02* (2006.01)
*C22C 38/04* (2006.01)

(52) U.S. Cl.
CPC ..... *C22C 38/18* (2013.01); *C22C 38/02* (2013.01); *C22C 38/04* (2013.01); *C21D 2211/008* (2013.01)

(58) Field of Classification Search
CPC ... C21D 2211/008; C22C 38/02; C22C 38/04; C22C 38/18; C23C 8/18
(Continued)

(56) References Cited

U.S. PATENT DOCUMENTS

2004/0244883 A1 12/2004 Onoda
2006/0201588 A1 9/2006 Suda et al.
(Continued)

FOREIGN PATENT DOCUMENTS

EP 3492616 A1 6/2019
JP S58-136780 A 8/1983
(Continued)

OTHER PUBLICATIONS

NPL: on-line translation of JP-2014169470-A, Sep. 2014 (Year: 2014).*
(Continued)

*Primary Examiner* — Jie Yang
(74) *Attorney, Agent, or Firm* — McCarter & English, LLP; Michael A. Sartori

(57) ABSTRACT

A spring steel wire includes a main body made of a steel and having a line shape, and an oxidized layer covering an outer peripheral surface of the main body. The steel constituting the main body contains not less than 0.62 mass % and not more than 0.68 mass % C, not less than 1.6 mass % and not more than 2 mass % Si, not less than 0.2 mass % and not more than 0.5 mass % Mn, not less than 1.7 mass % and not more than 2 mass % Cr, and not less than 0.15 mass % and not more than 0.25 mass % V, with the balance being Fe and unavoidable impurities. A value obtained by dividing a sum of a Si content and a Mn content by a Cr content is not less than 0.9 and not more than 1.4. The steel constituting the main body has a tempered martensite structure.

4 Claims, 2 Drawing Sheets

(58) Field of Classification Search
USPC ..... 420/104
See application file for complete search history.

(56) References Cited

U.S. PATENT DOCUMENTS

| | | | |
|---|---|---|---|
| 2007/0137741 | A1 | 6/2007 | Yoshihara |
| 2008/0279714 | A1 | 11/2008 | Hashimura et al. |
| 2009/0065105 | A1 | 3/2009 | Kochi et al. |
| 2009/0269578 | A1 | 10/2009 | Takeda et al. |
| 2014/0193288 | A1 | 7/2014 | Teramoto et al. |
| 2016/0348221 | A1 | 12/2016 | Sugimura et al. |
| 2018/0320255 | A1 | 11/2018 | Sugimura et al. |
| 2022/0186803 | A1* | 6/2022 | Izumida ..... C22C 38/04 |

FOREIGN PATENT DOCUMENTS

| | | | |
|---|---|---|---|
| JP | H08-39416 | A | 2/1996 |
| JP | 2004-052048 | A | 2/2004 |
| JP | 2004-115859 | A | 4/2004 |
| JP | 2004-315968 | A | 11/2004 |
| JP | 2006-28619 | A | 2/2006 |
| JP | 2006-183136 | A | 7/2006 |
| JP | 2006-342400 | A | 12/2006 |
| JP | 2007-169688 | A | 7/2007 |
| JP | 2008-266725 | A | 11/2008 |
| JP | 2009-068030 | A | 4/2009 |
| JP | 2009-235523 | A | 10/2009 |
| JP | 2009-263750 | A | 11/2009 |
| JP | 2012-077367 | A | 4/2012 |
| JP | 2014169470 | A * | 9/2014 |
| JP | 2017115228 | A * | 6/2017 |
| JP | 2018-12868 | A | 1/2018 |
| KR | 2014-0010700 | A | 1/2014 |
| WO | 2013/024876 | A1 | 2/2013 |
| WO | 2015/115574 | A1 | 8/2015 |
| WO | 2018/021574 | A1 | 2/2018 |

OTHER PUBLICATIONS

NPL: online translation of JP-2017115228-A, Jun. 2017 (Year: 2017).*
Non-Final Office Action issued in U.S. Appl. No. 17/058,282, dated Jul. 17, 2023.

* cited by examiner

SPRING STEEL WIRE

TECHNICAL FIELD

The present disclosure relates to a steel wire for mechanical springs.

BACKGROUND ART

Various oil quenched and tempered wires (spring steel wires) intended to improve the fatigue strength of a spring are known (see, for example, Japanese Patent Application Laid-Open No. 2004-315968 (Patent Literature 1), Japanese Patent Application Laid-Open No. 2006-183136 (Patent Literature 2), Japanese Patent Application Laid-Open No. 2008-266725 (Patent Literature 3), Japanese Translation of PCT International Publication No. 2013/024876 (Patent Literature 4), Japanese Patent Application Laid-Open No. 2012-077367 (Patent Literature 5), and Japanese Translation of PCT International Publication No. 2015/115574 (Patent Literature 6)).

CITATION LIST

Patent Literature

Patent Literature 1: Japanese Patent Application Laid-Open No. 2004-315968

Patent Literature 2: Japanese Patent Application Laid-Open No. 2006-183136

Patent Literature 3: Japanese Patent Application Laid-Open No. 2008-266725

Patent Literature 4: Japanese Translation of PCT International Publication No. 2013/024876

Patent Literature 5: Japanese Patent Application Laid-Open No. 2012-077367

Patent Literature 6: Japanese Translation of PCT International Publication No. 2015/115574

SUMMARY OF INVENTION

A spring steel wire according to the present disclosure includes a main body made of a steel and having a line shape, and an oxidized layer covering an outer peripheral surface of the main body. The steel constituting the main body contains not less than 0.62 mass % and not more than 0.68 mass % C (carbon), not less than 1.6 mass % and not more than 2 mass % Si (silicon), not less than 0.2 mass % and not more than 0.5 mass % Mn (manganese), not less than 1.7 mass % and not more than 2 mass % Cr (chromium), and not less than 0.15 mass % and not more than 0.25 mass % V (vanadium), with the balance being Fe and unavoidable impurities. A value obtained by dividing a sum of a Si content and a Mn content by a Cr content is not less than 0.9 and not more than 1.4. The steel constituting the main body has a tempered martensite structure.

DESCRIPTION OF EMBODIMENTS

Figure 1:
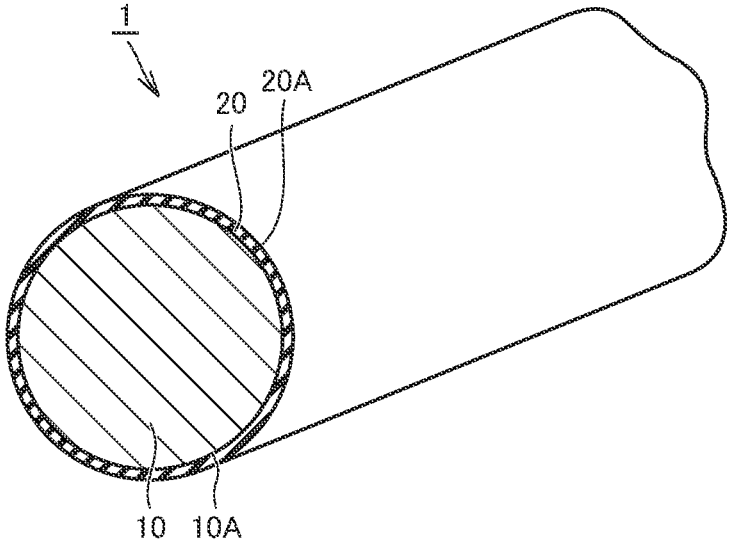
FIG. 1 is a schematic diagram showing the structure of a spring steel wire.

Problem to be Solved by the Present Disclosure

To produce springs requiring high fatigue strength, such as valve springs and torsional damper springs for automobile engines, nitriding processing may be performed after a steel wire (oil quenched and tempered wire) having undergone quenching and tempering is worked (coiled) into a spring shape. With the nitriding processing, a nitrided layer (hardened layer) is formed on the surface of the spring, leading to an improved fatigue strength of the spring.

However, there are cases where the spring fatigue strength would not be improved sufficiently even when the nitriding processing is performed. One object of the present disclosure is to provide a spring steel wire that ensures an improved fatigue strength of the spring.

Advantageous Effects of the Present Disclosure

The spring steel wire according to the present disclosure can improve the fatigue strength of the spring.

Description of Embodiment of the Present Disclosure

Firstly, an embodiment of the present disclosure will be listed and described. A spring steel wire according to the present disclosure includes a main body made of a steel and having a line shape, and an oxidized layer covering an outer peripheral surface of the main body. The steel constituting the main body contains not less than 0.62 mass % and not more than 0.68 mass % C, not less than 1.6 mass % and not more than 2 mass % Si, not less than 0.2 mass % and not more than 0.5 mass % Mn, not less than 1.7 mass % and not more than 2 mass % Cr, and not less than 0.15 mass % and not more than 0.25 mass % V, with the balance being Fe and unavoidable impurities. A value obtained by dividing a sum of a Si content and a Mn content by a Cr content is not less than 0.9 and not more than 1.4. The steel constituting the main body has a tempered martensite structure.

The present inventors investigated the reasons why the spring fatigue strength would not improve sufficiently even when nitriding processing was performed. As a result, the inventors obtained the following findings, and have reached the spring steel wire of the present disclosure.

There are cases where an oxidized layer is formed on the surface of a spring steel wire for the purposes of improving lubricity between the spring steel wire and the working tool during the coiling process. With the formation of the oxidized layer, the concentrations of Si and Mn, which are elements having a high affinity for oxygen (O), increase in the vicinity of the surface. The oxidized layer is removed by shot peening and the like performed after the coiling process, and the region with high Si and Mn concentrations remains in the vicinity of the surface. As a result, in the nitriding processing performed thereafter, Si and Mn present in the vicinity of the surface block penetration of nitrogen (N). This results in a reduced thickness of the nitrided layer (hardened layer), leading to a reduced effect of enhancing the fatigue strength by the nitriding processing.

On the other hand, investigations conducted by the present inventors have revealed that the nitrided layer (hardened layer) is increased in thickness when a value obtained by dividing the sum of a Si content and a Mn content by a Cr content in the steel constituting the spring steel wire (the value of (Si+Mn)/Cr) is adjusted to an appropriate range, or more specifically, to be not less than 0.9 and not more than 1.4. This results in an improved fatigue strength of the spring.

In the spring steel wire of the present disclosure, the steel constituting the main body has its constituent elements contained in appropriate amounts, and the steel constituting the main body has a tempered martensite structure. The main body is covered with the oxidized layer. The value of (Si+Mn)/Cr is set to be not less than 0.9 and not more than 1.4. Consequently, despite the increased Si and Mn concentrations in the vicinity of the surface of the main body (in the vicinity of the outer peripheral surface) due to the formation of the oxidized layer contributing to the improved lubricity between the spring steel wire and the working tool during the coiling process, the nitriding processing performed after the coiling process can readily form a nitrided layer of a sufficient thickness. This improves the fatigue strength of the spring. Accordingly, the spring steel wire of the present disclosure ensures an improved fatigue strength of the spring.

The reasons for limiting the component composition of the steel constituting the main body to the above-described ranges will be described below.

Carbon (C): not less than 0.62 mass % and not more than 0.68 mass %

C is an element that greatly affects the strength of a steel having a tempered martensite structure. For achieving sufficient strength as a spring steel wire, the C content is required to be not less than 0.62 mass %. On the other hand, an increased C content may reduce toughness, making working difficult. For ensuring sufficient toughness, the C content is required to be not more than 0.68 mass %.

Silicon (Si): not less than 1.6 mass % and not more than 2 mass %

Si has a property of suppressing softening due to heating (resistance to softening). For suppressing softening due to heating at the time of coiling the spring steel wire into a spring as well as at the time of using the spring, the Si content is required to be not less than 1.6 mass %, and it may be not less than 1.7 mass %. On the other hand, Si added in an excessive amount will reduce toughness. For ensuring sufficient toughness, the Si content is required to be not more than 2 mass %. From the standpoint of focusing on the toughness, the Si content may be not more than 1.9 mass %.

Manganese (Mn): not less than 0.2 mass % and not more than 0.5 mass %

Mn is an element added as a deoxidizing agent at the time of steelmaking. To achieve the function as the deoxidizing agent, the Mn content is required to be not less than 0.2 mass %. On the other hand, Mn added in an excessive amount will reduce toughness. Thus, the Mn content is required to be not more than 0.5 mass %, and it may be not more than 0.4 mass %.

Chromium (Cr): not less than 1.7 mass % and not more than 2 mass %

Cr has an effect of improving hardenability of a steel. Further, Cr functions as a carbide-forming element in the steel, and contributes to the refinement of the metal structure and also to the suppression of softening during heating as a result of formation of fine carbides. To ensure that these effects are achieved, Cr is required to be added in an amount of not less than 1.7 mass %. On the other hand, Cr added in an excessive amount will cause degradation of toughness. Thus, the amount of Cr added is required to be not more than 2 mass %, and it is preferably not more than 1.9 mass %.

Vanadium (V): not less than 0.15 mass % and not more than 0.25 mass %

V also functions as a carbide-forming element in the steel, and contributes to the refinement of the metal structure and also to the suppression of softening during heating as a result of formation of fine carbides. V carbides, having a high dissolution temperature, are present without being dissolved during quenching and tempering of the steel, so they contribute particularly greatly to the refinement of the metal structure (refinement of crystal grains). Further, the nitriding processing performed after the coiling process forms V nitrides, which may suppress the occurrence of slippage in crystals when repeated stress is applied to the spring, thereby contributing to the improvement in fatigue strength. To ensure that these effects are achieved, V is required to be added in an amount of not less than 0.15 mass %. On the other hand, V added in an excessive amount will cause degradation of toughness. Thus, the amount of V added is required to be not more than 0.25 mass %.

Unavoidable Impurities

During the process of producing the steel constituting a spring steel wire, phosphorus (P), sulfur (S), etc. are inevitably mixed into the steel. Phosphorus and sulfur contained in an excessive amount will cause grain boundary segregation and produce inclusions, thereby degrading the properties of the steel. Therefore, the phosphorus content and sulfur content are each preferably not more than 0.025 mass %. Nickel (Ni) and cobalt (Co), which are austenite-forming elements, tend to form residual austenite during quenching. In the residual austenite, C may be dissolved in a large amount, which decreases the amount of carbon within the martensite, probably causing reduction in hardness of the steel constituting the main body. The reduced hardness leads to a reduced fatigue strength. Thus, Ni and Co are contained in an amount present as unavoidable impurities, without being added intentionally. Further, titanium (Ti), niobium (Nb), and molybdenum (Mo), which are carbide-forming elements, elongate time required for pearlite transformation in the patenting processing performed before wire drawing processing, thereby reducing the steel wire production efficiency. Thus, Ti, Ni, and Mo are contained in an amount present as unavoidable impurities, without being added intentionally. The content of Ni as an unavoidable impurity is not more than 0.1 mass %, for example. The content of Co as an unavoidable impurity is not more than 0.1 mass %, for example. The content of Ti as an unavoidable impurity is not more than 0.005 mass %, for example. The content of Nb as an unavoidable impurity is not more than 0.05 mass %, for example. The content of Mo as an unavoidable impurity is not more than 0.05 mass %, for example.

Value of (Si+Mn)/Cr: not less than 0.9 and not more than 1.4

According to the studies conducted by the present inventors, the value of (Si+Mn)/Cr greatly affects the ease of forming a nitrided layer in the nitriding processing performed after the coiling process. Setting the value of (Si+Mn)/Cr to be not less than 0.9 and not more than 1.4 can facilitate the formation of a nitrided layer having a sufficient thickness. The reasons why such an effect is obtained can be considered for example as follows (although not restricted to the following theory). As explained previously, an oxidized layer is formed on the surface of the spring steel wire of the present disclosure for the purposes of improving lubricity between the spring steel wire and the working tool during the coiling process. With the formation of the oxidized layer, Si and Mn, which are elements having a high affinity for O, are increased in concentration in the vicinity of the surface. As a result, in the subsequent nitriding processing, penetration of N is blocked by Si and Mn present in the vicinity of the surface. On the other hand, increasing the amount of Cr, having a high affinity for N, makes it easier for N to enter into the main body in the nitriding processing, thereby facilitating formation of a nitrided layer having a sufficient thickness. To ensure that such an effect can be achieved, the content of Cr relative to the total content of Si and Mn is required to be set high enough to make the value of (Si+Mn)/Cr not higher than 1.4. The diffusion rate of Cr in the steel is small as compared to those of Si, Mn, etc., so the increase in concentration in the vicinity of the surface of the main body during the nitriding processing is moderate. If the added amount is increased to the extent that the value of (Si+Mn)/Cr becomes less than 0.9, however, Cr will capture N in the vicinity of the surface of the main body, blocking penetration of N to the interior of the main body. This leads to a reduced thickness of the nitrided layer formed in the nitriding processing. For suppressing the occurrence of such a problem, the value of (Si+Mn)/Cr is required to be not less than 0.9.

In the spring steel wire described above, the oxidized layer may have a thickness of not less than 2 μm and not more than 5 μm. As explained previously, with the formation of the oxidized layer, a region containing Si and Mn (especially Si) in high concentration is formed in the vicinity of the surface of the main body. Consequently, a region with lower concentration of Si and the like is formed on the inner peripheral side of the region with increased concentration of Si and the like. As long as the value of (Si+Mn)/Cr described above is set to an appropriate value, sufficient penetration of N into the main body is maintained, and the formation of the region with lower concentration of Si and the like promotes the formation of the nitrided layer. Setting the thickness of the oxidized layer to be not less than 2 μm can reliably achieve such effects. On the other hand, in order to increase the thickness of the oxidized layer, the oxidizing processing time needs to be extended, which will increase the production cost of the spring steel wire. For suppressing the increase in production cost of the spring steel wire, the thickness of the oxidized layer is preferably not more than 5 μm.

In the spring steel wire described above, the oxidized layer may contain $Fe_3O_4$ in a percentage of not less than 80 mass %. Fe forms a plurality of types of oxides depending on the degree of progress of oxidation. Studies conducted by the present inventors have revealed that $Fe_3O_4$ is most preferable from the standpoint of lubricating effect during the coiling process. Setting the percentage of $Fe_3O_4$ in the oxidized layer to be not less than 80 mass % can further enhance the lubricating effect obtained by the oxidized layer during the coiling process. It should be noted that the percentage of $Fe_3O_4$ in the oxidized layer can be measured using, for example, a reference intensity ratio (RIR) method that uses X ray diffraction.

In the steel constituting the main body of the spring steel wire described above, the value obtained by dividing the sum of the Si content and the Mn content by the Cr content may be not less than 1 and not more than 1.2. Setting the value of (Si+Mn)/Cr to be not less than 1 and not more than 1.2 can further facilitate formation of the nitrided layer having a sufficient thickness.

The spring steel wire described above may have an outer diameter of not less than 0.5 mm and not more than 12 mm. The spring steel wire of the present disclosure is particularly suitable for the spring steel wire having the outer diameter of not less than 0.5 mm and not more than 12 mm. The outer diameter of the spring steel wire is more preferably not less than 2 mm and not more than 8 mm. It should be noted that the outer diameter of the spring steel wire refers to a diameter of a circular cross section perpendicular to the longitudinal direction of the steel wire. In the case where the cross section perpendicular to the longitudinal direction of the steel wire is other than the circular shape, the outer diameter of the spring steel wire refers to a diameter of the smallest circle that circumscribes the cross section.

Details of Embodiment of the Present Invention

An embodiment of the spring steel wire according to the present disclosure will be described below with reference to the drawings. In the following drawings, the same or corresponding parts are denoted by the same reference numerals, and the description thereof will not be repeated.

Figure 2:
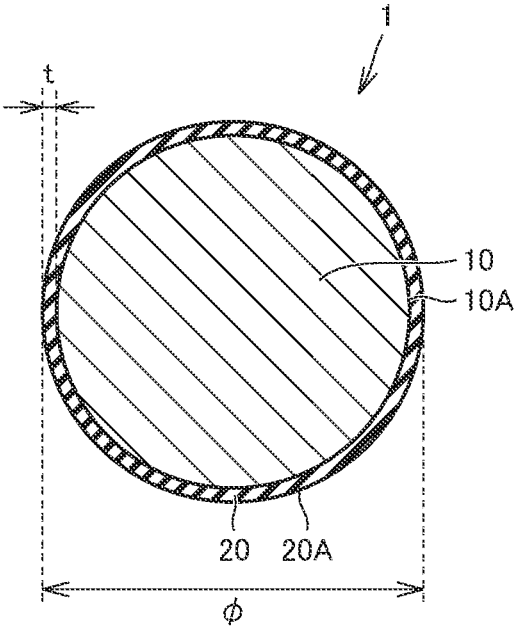
FIG. 2 is a schematic cross-sectional view showing the structure of the spring steel wire.

FIG. 1 is a schematic diagram showing the structure of a spring steel wire. FIG. 2 is a schematic cross-sectional view showing the structure of the spring steel wire. FIG. 2 shows a cross section perpendicular to the longitudinal direction of the spring steel wire.

Referring to FIGS. 1 and 2, a spring steel wire 1 according to the present embodiment includes a main body 10 made of a steel and having a line shape, and an oxidized layer 20 covering an outer peripheral surface 10A of the main body 10. The oxidized layer 20 has an outer peripheral surface 20A that constitutes an outer peripheral surface of the spring steel wire 1. Referring to FIG. 2, the spring steel wire 1 has a diameter ϕ of, for example, not less than 2 mm and not more than 8 mm. The oxidized layer 20 has a thickness t of, for example, not less than 2 μm and not more than 5 μm.

The steel constituting the main body 10 contains not less than 0.62 mass % and not more than 0.68 mass % C, not less than 1.6 mass % and not more than 2 mass % Si, not less than 0.2 mass % and not more than 0.5 mass % Mn, not less than 1.7 mass % and not more than 2 mass % Cr, and not less than 0.15 mass % and not more than 0.25 mass % V, with the balance being Fe and unavoidable impurities. A value obtained by dividing a sum of a Si content and a Mn content by a Cr content (value of (Si+Mn)/Cr) is not less than 0.9 and not more than 1.4. The steel constituting the main body 10 has a tempered martensite structure. The spring steel wire 1 of the present embodiment is an oil quenched and tempered wire.

In the spring steel wire 1 of the present embodiment, the contents of the constituent elements of the steel constituting the main body 10 have been set appropriately, and the steel constituting the main body 10 has a tempered martensite structure. The main body 10 is covered with the oxidized layer 20. The value of (Si+Mn)/Cr is set to be not less than 0.9 and not more than 1.4. Consequently, despite the increased Si and Mn concentrations in the vicinity of the outer peripheral surface 10A of the main body 10 due to the formation of the oxidized layer 20 contributing to the improvement in lubricity between the spring steel wire 1 and the working tool during the coiling process, a nitrided layer can readily be formed with a sufficient thickness in the nitriding processing performed after the coiling process. This improves the fatigue strength of the spring. Accordingly, the spring steel wire 1 is a spring steel wire that ensures an improved fatigue strength of the spring.

The percentage of $Fe_3O_4$ in the oxidized layer 20 in the present embodiment is preferably 80 mass % or more. This can further enhance the lubricating effect of the oxidized layer 20 during the coiling process.

In the steel constituting the main body 10 of the present embodiment, the value obtained by dividing the sum of the Si content and the Mn content by the Cr content is preferably not less than 1 and not more than 1.2. Setting the value of (Si+Mn)/Cr to be 1 or more and 1.2 or less can further facilitate formation of the nitrided layer with a sufficient thickness.

Figure 3:
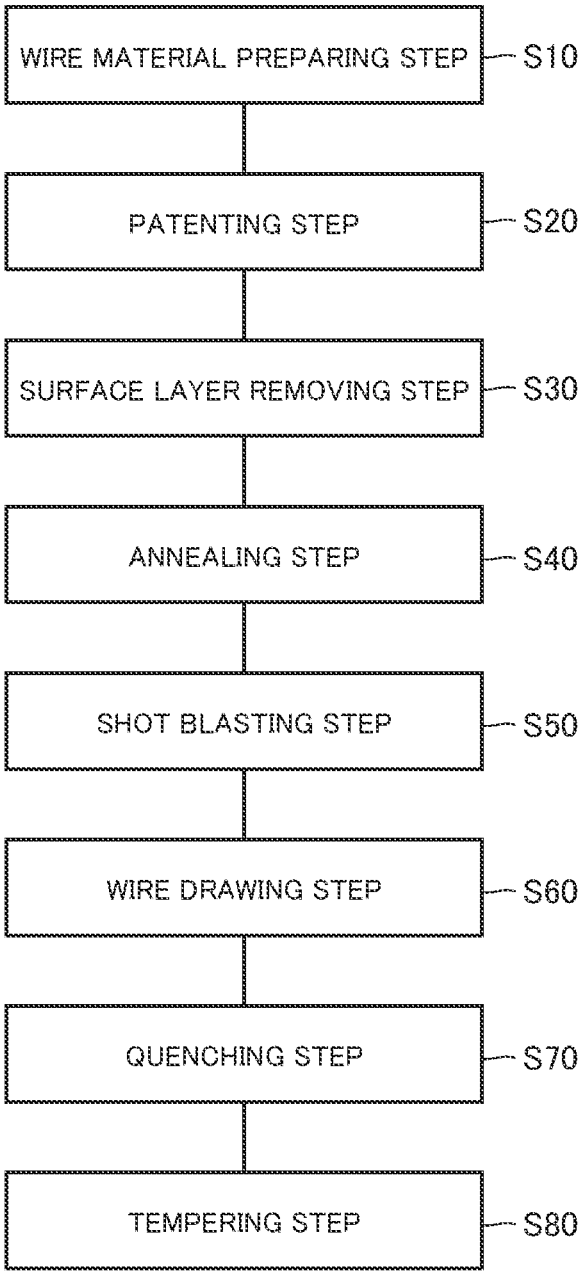
FIG. 3 is a flowchart schematically illustrating a method of producing a spring steel wire.

An exemplary method of producing the spring steel wire 1 will now be described with reference to FIG. 3. FIG. 3 is a flowchart schematically illustrating the method of producing the spring steel wire 1 in the present embodiment. Referring to FIG. 3, in the method of producing the spring steel wire 1 in the present embodiment, firstly, a wire material preparing step is performed as a step S10. In the step S10, a wire material of steel is prepared, wherein the steel contains not less than 0.62 mass % and not more than 0.68 mass % C, not less than 1.6 mass % and not more than 2 mass % Si, not less than 0.2 mass % and not more than 0.5 mass % Mn, not less than 1.7 mass % and not more than 2 mass % Cr, and not less than 0.15 mass % and not more than 0.25 mass % V, with the balance being Fe and unavoidable impurities, and the value of (Si+Mn)/Cr is not less than 0.9 and not more than 1.4.

Next, referring to FIG. 3, a patenting step is performed as a step S20. In the step S20, referring to FIG. 3, the wire material prepared in the step S10 is subjected to patenting. Specifically, the wire material is subjected to heat treatment in which the wire material is heated to a temperature range not lower than the austenitizing temperature ($A_1$ point), and then rapidly cooled to a temperature range higher than the martensitic transformation start temperature ($M_s$ point) and held in the temperature range. With this, the wire material attains a fine pearlite structure with small lamellar spacing. Here, in the patenting processing, the process of heating the wire material to the temperature range not lower than the $A_1$ point is preferably performed in an inert gas atmosphere from the standpoint of suppressing the occurrence of decarburization.

Next, referring to FIG. 3, a surface layer removing step is performed as a step S30. In the step S30, a surface layer of the wire material having undergone the patenting in the step S20 is removed. Specifically, the wire material is passed through a shaving die, for example, whereby a decarburized layer or the like on the surface formed through the patenting is removed. Although this step is not an indispensable step, even if a decarburized layer or the like is formed on the surface due to the patenting, such a layer can be removed by performing this step.

Next, an annealing step is performed as a step S40. In the step S40, the wire material with its surface layer removed in the step S30 is subjected to annealing. Specifically, the wire material is subjected to heat treatment in which the wire material is heated to a temperature range not lower than 600° C. and not higher than 700° C. in an inert gas (such as nitrogen or argon gas) atmosphere, for example, and held for a period of not shorter than one hour and not longer than ten hours. While annealing is a heat treatment performed for softening a wire material, in the present embodiment, an oxidized layer 20 is formed and the percentage of $Fe_3O_4$ in the oxidized layer 20 is adjusted in this step S40. As to the atmosphere as well, instead of the usual inert gas atmosphere, an atmosphere in which the inert gas is intentionally mixed with the air, or an atmosphere in which the inert gas is mixed with water vapor may be used.

Next, a shot blasting step is performed as a step S50. In the step S50, the wire material having undergone the annealing processing in the step S40, with the oxidized layer 20 formed thereon, is subjected to shot blasting. Although the step is not indispensable, performing this step makes it possible to remove brittle $Fe_2O_3$ formed on the surface of the oxidized layer 20 and to adjust the percentage of $Fe_3O_4$ in the oxidized layer 20. The percentage of $Fe_3O_4$ can be adjusted by adjusting the intensity and time of the shot blasting.

Next, a wire drawing step is performed as a step S60. In the step S60, the wire material having undergone the shot blasting in the step S50 is subjected to wire drawing process (drawing process). The degree of working (reduction of area) in the wire drawing process in the step S60 may be set as appropriate; for example, the reduction of area may be set to be not less than 50% and not more than 90%. Here, the "reduction of area" relates to a cross section perpendicular to the longitudinal direction of the wire material, and refers to a value, expressed in percentage, obtained by dividing a difference between the cross-sectional areas before and after the wire drawing process by the cross-sectional area before the wire drawing process.

Next, a quenching step is performed as a step S70. In the step S70, the wire material (steel wire) having undergone the wire drawing process in the step S60 is subjected to quenching treatment in which the steel wire is heated to a temperature not lower than the $A_1$ point of the steel and then rapidly cooled to a temperature not higher than the $M_s$ point. More specifically, for example, the steel wire is heated to a temperature not lower than 800° C. and not higher than 1000° C. and then immersed in oil for rapid cooling. With this, the steel constituting the main body attains a martensite structure.

Next, a tempering step is performed as a step S80. In the step S80, the steel wire having undergone the quenching treatment in the step S70 is subjected to tempering treatment in which the steel wire is heated to a temperature lower than the $A_1$ point of the steel and then cooled. The heating of the steel wire is performed by immersing the steel wire in oil maintained at a prescribed temperature. More specifically, for example, the steel wire is heated to a temperature not lower than 400° C. and not higher than 700° C., and held for a period of not shorter than 0.5 minutes and not longer than 20 minutes before being cooled. With this, the steel constituting the main body attains a tempered martensite structure. The spring steel wire 1 according to the present embodiment is produced through the above-described procedure.

EXAMPLES (Experiment 1)

An experiment was conducted to investigate the relationship between the component composition of the steel constituting the main body on one hand and the state of formation of a hardened layer (nitrided layer) and the spring fatigue strength on the other hand.

Spring steel wires having a diameter ϕ of 4.0 mm were prepared in a similar procedure as in the above embodiment. The steel wires prepared included six types of steel wires in which the steel constituting the main body had a composition falling within the component composition range of the spring steel wire of the present disclosure, and eight types of steel wires falling outside that range. At this time, the surfaces of the wire materials were oxidized in the step S40. As a result, the prepared spring steel wires had an oxidized layer with a thickness of about 3.0 μm (not less than 2.7 μm and not more than 3.3 μm). The spring steel wires were each formed into a compression spring, and then sequentially subjected to stress-relieving annealing, oxidized scale removal, nitriding, shot peening, and setting. Nitriding was performed under the conditions that a spring was heated to 440° C. in an atmosphere with ammonia gas as the main ingredient and containing carbon dioxide gas and nitrogen gas, and held for five hours. For the springs thus obtained, hardness distribution in the vicinity of the surface of the spring was investigated. The springs were also subjected to a fatigue test. The component compositions of the steels constituting the main body are shown in Table 1.

TABLE 1

| | C | Si | Mn | Cr | V | (Si + Mn)/Cr |
|---|---|---|---|---|---|---|
| A | 0.65 | 1.61 | 0.23 | 1.98 | 0.21 | 0.93 |
| B | 0.64 | 1.65 | 0.31 | 1.95 | 0.18 | 1.01 |
| C | 0.63 | 1.72 | 0.40 | 1.96 | 0.16 | 1.08 |
| D | 0.62 | 1.85 | 0.44 | 1.91 | 0.23 | 1.20 |
| E | 0.66 | 1.98 | 0.49 | 1.93 | 0.17 | 1.28 |
| F | 0.68 | 2.00 | 0.48 | 1.81 | 0.16 | 1.37 |
| G | 0.65 | 1.97 | 0.46 | 1.65 | 0.21 | 1.47 |
| H | 0.65 | 1.98 | 0.48 | 1.52 | 0.19 | 1.62 |
| I | 0.64 | 2.08 | 0.53 | 1.70 | 0.24 | 1.54 |
| J | 0.63 | 2.18 | 0.61 | 1.71 | 0.17 | 1.63 |
| K | 0.67 | 1.48 | 0.22 | 1.99 | 0.16 | 0.85 |
| L | 0.63 | 1.37 | 0.20 | 2.00 | 0.17 | 0.79 |
| M | 0.65 | 1.61 | 0.25 | 2.22 | 0.22 | 0.84 |
| N | 0.67 | 1.62 | 0.23 | 2.31 | 0.18 | 0.80 |

As shown in Table 1, 14 types of spring steel wires differing in component composition of the steel constituting the main body were prepared. Table 1 shows the contents of C, Si, Mn, Cr, and V in mass %. The remainder other than C, Si, Mn, Cr, and V consists of Fe and unavoidable impurities. Table 1 also shows a value of (Si+Mn)/Cr.

Table 2 shows hardness distribution in the vicinity of the surface of the spring, together with the value of (Si+Mn)/Cr. The hardness distribution was obtained as follows. The spring steel wire constituting the spring was cut in a cross section perpendicular to the longitudinal direction, and for the obtained cross section, the hardness at a position corresponding to each depth (distance from the surface) was measured. Each value in Table 2 indicates the Vickers hardness. The value at "depth 0" indicates a surface hardness of the spring steel wire. The surface hardness is not a hardness at the cross section of the spring, but is a hardness (Vickers hardness) of the outer peripheral surface of the spring steel wire constituting the spring.

TABLE 2

| | | | Hardness (Hv) | | | | |
|---|---|---|---|---|---|---|---|
| | Steel | (Si + Mn)/Cr | 0 μm | 60 μm | 80 μm | 100 μm | 120 μm |
| 1 | A | 0.93 | 963 | 666 | 644 | 628 | 616 |
| 2 | B | 1.01 | 957 | 683 | 661 | 640 | 621 |
| 3 | C | 1.08 | 982 | 686 | 656 | 636 | 625 |
| 4 | D | 1.20 | 969 | 679 | 652 | 633 | 619 |
| 5 | E | 1.28 | 972 | 665 | 642 | 631 | 613 |
| 6 | F | 1.37 | 976 | 667 | 639 | 627 | 617 |
| 7 | G | 1.47 | 958 | 632 | 615 | 608 | 613 |
| 8 | H | 1.62 | 968 | 633 | 614 | 611 | 610 |
| 9 | I | 1.54 | 982 | 629 | 617 | 615 | 618 |
| 10 | J | 1.63 | 976 | 625 | 615 | 618 | 615 |
| 11 | K | 0.85 | 981 | 631 | 608 | 611 | 609 |
| 12 | L | 0.79 | 975 | 634 | 609 | 608 | 606 |
| 13 | M | 0.84 | 984 | 640 | 609 | 610 | 610 |
| 14 | N | 0.80 | 967 | 637 | 615 | 613 | 611 |

As shown in Table 2, the surface hardness is affected by the contents of elements such as Cr and V that contribute to occurrence of secondary hardening. On the other hand, it is confirmed that the hardness inside the spring, particularly at the depth of about 80 μm to about 100 μm corresponding to the thickness of the nitrided layer, is higher in the steels A to F (samples 1 to 6) corresponding to the examples of the present disclosure in which the value of (Si+Mn)/Cr is not less than 0.9 and not more than 1.4. In particular, the hardness near the depth of 80 μm to 100 μm is especially high in the steels B to D (samples 2 to 4) in which the value of (Si+Mn)/Cr is not less than 1.0 and not more than 1.2.

Table 3 shows results of the spring fatigue test.

TABLE 3

| | | | Number of Unbroken Pieces | |
|---|---|---|---|---|
| | Steel | (Si + Mn)/Cr | $5.0 \times 10^7$ times | $1.0 \times 10^8$ times |
| 1 | A | 0.93 | 8 | 6 |
| 2 | B | 1.01 | 8 | 8 |
| 3 | C | 1.08 | 8 | 8 |
| 4 | D | 1.20 | 8 | 8 |
| 5 | E | 1.28 | 8 | 7 |
| 6 | F | 1.37 | 8 | 4 |
| 7 | G | 1.47 | 7 | 1 |
| 8 | H | 1.62 | 3 | 0 |
| 9 | I | 1.54 | 5 | 0 |
| 10 | J | 1.63 | 2 | 0 |
| 11 | K | 0.85 | 5 | 1 |
| 12 | L | 0.79 | 0 | 0 |
| 13 | M | 0.84 | 4 | 0 |
| 14 | N | 0.80 | 1 | 0 |

For each of the samples 1 to 14, eight springs were prepared, which were subjected to the fatigue test. The fatigue test was conducted using a star fatigue tester for springs. The test was conducted under the conditions of the average stress of 686 MPa on the inner peripheral surface of the spring and the stress amplitude of 630 MPa. The fatigue strength was evaluated according to the number of unbroken springs at the time points of stress repetitions of $5.0\times10^7$ times and $1.0\times10^8$ times. Table 3 shows the numbers of unbroken springs at the stress repetitions of $5.0\times10^7$ times and $1.0\times10^8$ times.

As shown in Table 3, the fatigue strength is high in the steels A to F (samples 1 to 6) corresponding to the examples of the present disclosure in which the value of (Si+Mn)/Cr is not less than 0.9 and not more than 1.4. This is conceivably because the hardness has been increased from the surface to the depth of about 80 μm to about 100 μm in the steels A to F (samples 1 to 6) as explained above. In particular, it can be said that the steels B to D (samples 2 to 4) with the value of (Si+Mn)/Cr of not less than 1.0 and not more than 1.2 have a remarkably high fatigue strength.

The above experimental results demonstrate that the spring steel wire of the present disclosure ensures an improved fatigue strength of the spring.

(Experiment 2)

An experiment was conducted to investigate the relationship between the thickness of the oxidized layer on one hand and the state of formation of a hardened layer (nitrided layer) and the spring fatigue strength on the other hand. The steel constituting the main body was the steel A, and the oxidation conditions in the step S40 were changed to prepare six types of steel wires differing in thickness of the oxidized layer. The spring steel wires were each formed into a compression spring, and then sequentially subjected to the same processing as in Experiment 1. For the springs thus obtained, hardness distribution in the vicinity of the surface of the spring was investigated, and the springs were also subjected to the fatigue test, as in Experiment 1.

Table 4 shows hardness distribution in the vicinity of the surface of the spring, together with the value of (Si+Mn)/Cr. The hardness distribution was measured in the same manner as in Experiment 1.

TABLE 4

| | Steel | Thickness of Oxidized Layer (μm) | Depth (μm) 0 | 60 | 80 | 100 | 120 |
|---|---|---|---|---|---|---|---|
| 15 | A | 3.3 | 963 | 666 | 644 | 628 | 616 |
| 16 | A | 2.1 | 974 | 669 | 642 | 624 | 615 |
| 17 | A | 4.1 | 962 | 671 | 652 | 631 | 623 |
| 18 | A | 5.0 | 962 | 678 | 652 | 628 | 620 |
| 19 | A | 1.3 | 954 | 649 | 632 | 623 | 612 |
| 20 | A | 6.3 | 961 | 653 | 635 | 622 | 611 |

It is understood that the hardness inside the spring, particularly at the depth of about 80 μm to about 100 μm corresponding to the depth of the nitrided layer, is especially high in the samples 15 to 18 in which the thickness of the oxidized layer is not less than 2 um and not more than 5 μm.

Table 5 shows the results of the spring fatigue test.

TABLE 5

| | Steel | Thickness of Oxidized Layer (μm) | Number of Unbroken Pieces $5.0 \times 10^7$ times | $1.0 \times 10^8$ times |
|---|---|---|---|---|
| 15 | A | 3.3 | 8 | 6 |
| 16 | A | 2.1 | 8 | 6 |
| 17 | A | 4.1 | 8 | 8 |
| 18 | A | 5.0 | 8 | 7 |
| 19 | A | 1.3 | 8 | 4 |
| 20 | A | 6.3 | 8 | 3 |

The samples 15 to 20 were each subjected to the fatigue test similarly as in Experiment 1. Table 5 shows the numbers of unbroken springs at the stress repetitions of $5.0\times10^7$ times and $1.0\times10^8$ times.

As shown in Table 5, the fatigue strength is high in the samples 15 to 18 in which the thickness of the oxidized layer is not less than 2 μm and not more than 5 μm. This is conceivably because the hardness has been increased from the surface to the depth of about 80 μm to about 100 μm in the samples 15 to 18 as explained above.

The above experimental results demonstrate that the thickness of the oxidized layer is preferably not less than 2 μm and not more than 5 μm.

It should be understood that the embodiment and examples disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1: spring steel wire; 10: main body; 10A: outer peripheral surface; 20: oxidized layer; 20A: outer peripheral surface; ϕ: diameter of spring steel wire; and t: thickness of oxidized layer.

The invention claimed is:

1. A spring steel wire comprising:

a main body made of a steel and having a line shape; and an oxidized layer covering an outer peripheral surface of the main body;

the steel constituting the main body containing not less than 0.62 mass % and not more than 0.68 mass % C, not less than 1.6 mass % and not more than 2 mass % Si, not less than 0.2 mass % and not more than 0.5 mass % Mn, not less than 1.7 mass % and not more than 2 mass % Cr, and not less than 0.15 mass % and not more than 0.25 mass % V, with the balance being Fe and unavoidable impurities, a value obtained by dividing a sum of a Si content and a Mn content by a Cr content being not less than 0.9 and not more than 1.4, the steel constituting the main body having a tempered martensite structure;

wherein the oxidized layer contains $Fe_3O_4$ in a percentage of not less than 80 mass %, and wherein the oxidized layer has thickness of not less than 2 μm and not more than 5 μm.

2. The spring steel wire according to claim 1, wherein in the steel constituting the main body, the value obtained by dividing the sum of the Si content and the Mn content by the Cr content is not less than 1 and not more than 1.2.

3. The spring steel wire according to claim 1, having an outer diameter of not less than 0.5 mm and not more than 12 mm.

4. A spring steel wire comprising:

a main body made of a steel and having a line shape; and an oxidized layer covering an outer peripheral surface of the main body;

the steel constituting the main body containing not less than 0.62 mass % and not more than 0.68 mass % C, not less than 1.6 mass % and not more than 2 mass % Si, not less than 0.2 mass % and not more than 0.5 mass % Mn, not less than 1.7 mass % and not more than 2 mass % Cr, and not less than 0.15 mass % and not more than 0.25 mass % V, with the balance being Fe and unavoidable impurities, a value obtained by dividing a sum of a Si content and a Mn content by a Cr content being not less than 1 and not more than 1.2, the steel constituting the main body having a tempered martensite structure wherein the oxidized layer has a thickness of not less than 2 μm and not more than 5 μm, the oxidized layer contains $Fe_3O_4$ in a percentage of not less than 80 mass %, and the spring steel wire has an outer diameter of not less than 0.5 mm and not more than 12 mm.

* * * * *